United States Patent [19]

Aracil

[11] Patent Number: 5,054,582

[45] Date of Patent: Oct. 8, 1991

[54] STICK COATING APPLICATOR HOLDER

[76] Inventor: Claude Aracil, 2128 E. Baltimore St., Baltimore, Md. 21231

[21] Appl. No.: 230,425

[22] Filed: Aug. 10, 1988

[51] Int. Cl.[5] ..... B61K 3/00

[52] U.S. Cl. ..... 184/3.2; 184/99

[58] Field of Search ..... 184/2, 3.1, 3.2, 99; 104/279; 198/500

[56] References Cited

U.S. PATENT DOCUMENTS 1,780,464 11/1930 Coppage ..... 184/3.2
2,727,589 12/1955 Campney ..... 184/3.2
2,866,521 12/1958 Gibson ..... 184/3.2

FOREIGN PATENT DOCUMENTS 0077956 8/1919 Fed. Rep. of Germany ..... 184/3.2

*Primary Examiner*—Ira S. Lazarus
*Assistant Examiner*—Alan B. Cariaso

[57] ABSTRACT

In the art of using, by frictionally applying, chemical lubricating compounds in stick form to moving objects, and more particularly applying to the moving flanges of vehicle wheels; the improvement in the structure of stick holders to provide ease of adjustment and uniform complete stick application by pressure.

4 Claims, 1 Drawing Sheet

STICK COATING APPLICATOR HOLDER

BACKGROUND OF THE INVENTION

With the advent of urban motorized transportation, and the increased cost of labor, there has arisen a urgent need for almost automatic application of lubricants to the flanges of rail transportation vehicles, in order to prevent the oscillations of high frequency, (making annoying sounds) due to the twisting of the axle and subsequent sudden release of the twist, as a curved rail is negotiated when the wheel-flange-rim-friction is overcome. This is specially true for solid two wheel axle units, which in turn, is due to the difference in length of the outer and inner track of the curve.

The use of a, vehicle mounted self regulating, lubricating system designed for steel-rail transit cars is old in the art. Some of the prior systems claim that they allow the entire stick of lubricant to wear away. In actual fact this is not correct. One of these systems employs a stick of lubricant that is provided within the stick, a non-lubricant bolt receiver, (for stick lubricant attachment purposes) which is imbedded in and made part of the lubricant stick. This bolt receiver and bolt end, if allowed, by lubricant stick wearing, to contact the wheel flange, would scar and damage that wheel flange, and also prevent the complete use of the lubricant stick.

Generally the use of spring loaded applicator stick systems, operate to press one end of the lubricator block or stick thru a holder, and against the moving wheel flange. The anti wear and anti friction agents are activated by the heat of friction between the polymer or plastic carrier components of the stick and the wheel flange, and it is this action of the friction between the wheel flange and the lubricant carrying stick that causes a thin film containing the lubricant to be delivered to, and coat a specific lubricant stripe on, the flange of the wheel.

Man generally has had a desire to simplify and improve the quality of the equipment that he is required to use from time to time and this desire usually results in the creation and disclosure of new and unobvious structures to effect improved functioning of the said equipment and make other useful innovations.

Quite a number of applicator assemblies and stick lubricants have been disclosed in the art, and some of them have even been patented. Each design and structure DISCLOSED in the past has certain advantages, and examples of some of these are shown in the U.S. Patents listed below:

U.S. Pat. No. 2,589,582, STRUGGHOLD
U.S. Pat. No. 2,326,000, TEEPLE
U.S. Pat. No. 1,185,682, KIRKEGARD
U.S. Pat. No. 1,102,473, CHAPPELL
Glidestar system—using DURAFILM TM produced by DURAFILM COORPORATION, 321 16th Ave. S, Seattle, Wash. 98144.

Each of the above has some disadvantage and thus suffers from comparison, considering the purposes and desired functions of the subject invention.

OBJECTS OF THE INVENTION

The invention herein disclosed shows an improvement in design, function and method of manufacture of applicator stick holders, and the making of such items and elements therefor, and other objects of this invention are to provide;

A. A more simple device (i.e. less parts) to accomplish substantially the same operation, as the prior described devices, B. A considerable saving in cost of manufacture and allows for a more compact, refillable, and rigid space saving device that can be adjusted with one hand, and can have the stick device replaced by means of a one hand operation; and allows less skilled labor to produce the quality results produced by the more skilled labor using the prior disclosed devices, C. For the use of a applicator stick that can be substantially completely used, without the danger of damage to the wheel flange surface involved, which of course prolongs the life of the wheel flange, D. A structure of simple pleasing appearance and design of almost self explanatory operation, and E. A structure that can be easily adjusted, without almost complete disassembly of the parts of the device.

SUMMARY OF THE INVENTION

The disclosed device is constructed and its function and mode of using, together with additional features and advantages thereof, will be best understood upon examination of the following detailed description of certain specific selected embodiments, and by reference to the accompanying drawings.

THE DESCRIPTION OF THE PREFERRED EMBODIMENTS

Figure 1:
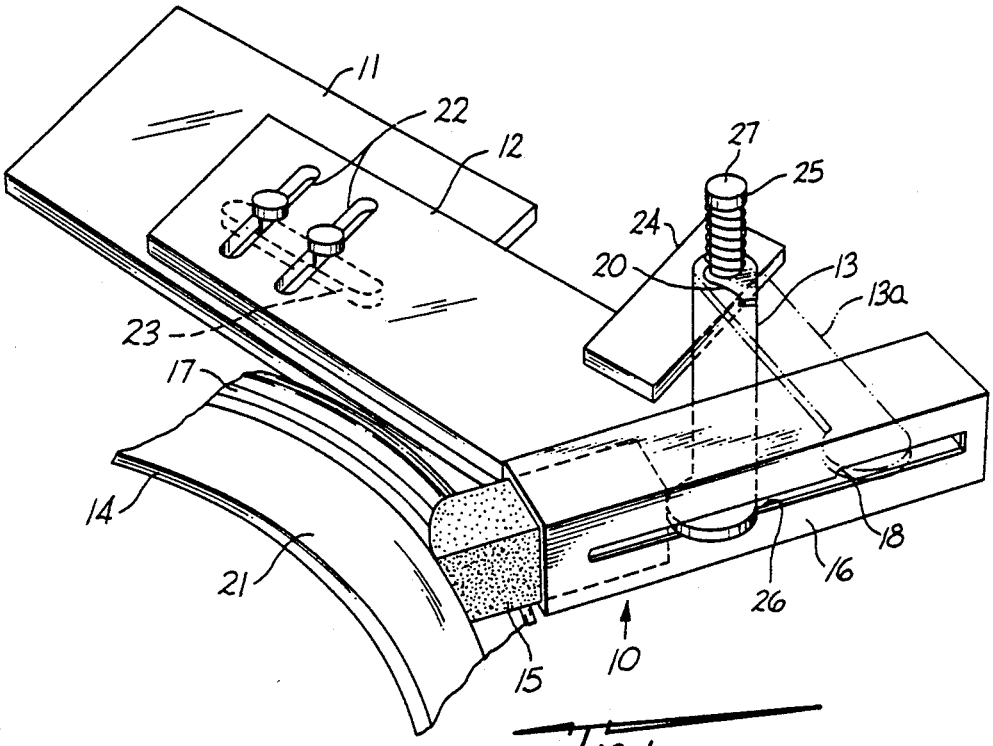
FIG. 1. Is an elevation -partial cut away- view of the external appearance of the subject invention.

As shown in FIG. 1

The applicator stick holder 10 is comprised of, a base attaching plate 11 two sets of forward and backward adjusting slots 22 cut therein and holder plate 12 with one set of left and right, or transverse adjusting slots 23 in one end, and an extension arm 24 at the other end. The extension has a spring 20 and pusher arm 13, and a pusher arm holding means 25 extending from the pivot 27 axis and substantially perpendicular to the axes of plate 11 and holder plate 12. Also, the said extension of the holder plate 12 is spaced from the said holder plate and may be at a slight angle to the applicator stick holder 16, which holds applicator stick 15 at such a position as to urge the applicator stick against the flange 17 of wheel 14; and not against the tread 21 of wheel 14.

Figure 2:
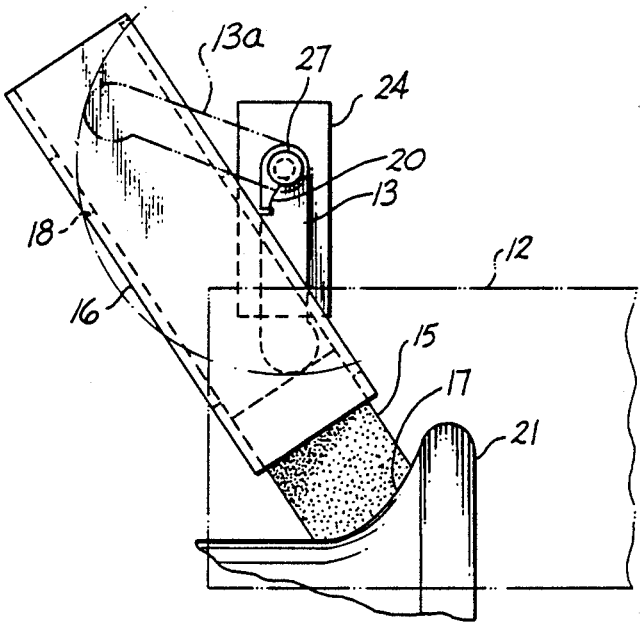
FIG. 2 Is an elevation view of a detail showing the holder with spring feeder and the applicator stick of the invention shown in FIG. 1, the applicator stick almost completely used.

By referring to the details of FIG. 2 it can be seen, that the pusher arm 13 can provide a substantially uniform pressure against the applicator stick 15, from the beginning loading position (shown in broken outline of arm) 13 a to the ending position (shown in solid lines) 13 as urged by spring 20. Also shown in this view is the pair or set of adjusting slots 23 that allow for transverse adjustment of the applicator holder 16 with relation to the wheel 21.

By referring to FIG. 1 it can be more clearly seen that at the time of replacement of the applicator stick 15; the spring urged arm 13 can be reset by urging the arm against the push of the spring 20 far enough to move the arm out of the arm groove or slot 26 so that the arm can be cocked and rested in the safety notch 18. The applicator stick 15 holder tube 16 structure; is comprised of a tube of substantially rectangular or annular cross section, according to the dictates of the shape of the lubricating applicator stick 15; it also has a comparatively slender slot 26 with a length of about 65%–90% length of the holder 16 sufficient to allow the pusher arm 13 to freely move to urge the applicator stick 15 forward. The holder 16 holds the stick firmly but freely so that the stick cannot jiggle, as is in the case of some of the devices disclosed in the prior art cited above. Also, by positioning the pivot 27 at a point approximately midway between the length of the holder 16, and at the side of the holder at a sufficient distance away from the path of the linear movement of the stick, so that the arc of the active edge of the pusher arm 13 which after being urged against the spring 20 as far as possible, that is in the cocked position, when released follows and pushes the applicator stick 15 in an arcuate path, such that equal pressure is applied first on the near (to the pivot) side of the applicator stick 15 and then as wear progresses, the contact point between the arm 13 and the end of the applicator stick 15 progresses to the far side of the stick and then as there is still further progress, the contact point progresses to the near side of the stick again, at the finish of the arcuate stroke. This makes for uniform pressure and wear on both sides of the stick. This geometric arrangement of the pusher arm allows the arm to travel a greater arcuate length through a first and second slot (FIG. 2) on the holder 16 opposite of each other for the same amount of angular partial rotary movement.

Having thus described the preferred embodiment, it is apparent from the examination of the specification and drawings that the parameters of this embodiment can be varied in a number of ways within this disclosure as defined by the claims hereinafter shown.

I claim:

1. In a device for adjustably holding and applying stick lubricants frictionally to the flanges of the rotating a frame of a vehicle the improvement comprising;

A slotted elongated tubular stick receiving and holding means open at both ends, and having a narrow elongated slot opening located substantially parallel to the axis and centrally on a first face of said holding means, said slot opening elongation is located centered of the length of the holding means and of a slot length of about 65% to 90% of the length of the holding means.

A stick-urging arm means of a length substantially equal in arcuate rotation to the slot length pivoted at one end and free at the opposite end and having the pivot located mid length of the slot and at a distance from the tubular holding means sufficient to allow the arm to swing within the slot opening as in a chord, and of a thinness sufficient to and having said pivoted end positioned to allow the free end of the arm to move in an arcuate path, thru said slot opening from a cocked or restrained position by urging the lubricating stick to the end of the arc swing and guided within the holding means, in continual urging contact with one end face of the stick lubricant, An adjustable bracket means having a first end and an opposite second adjustable end, said first end adapted to attach to the vehicle frame and said second end adapted to adjustably attach to said holding means to hold said holding means axis in a position against the travel path of the flange of the wheel to allow the urging contact with one end face of the stick lubricant to force the contact of the stick lubricant to frictionally contact the flange of the wheel as it rotates.

2. A device as in claim 1 wherein said narrow elongated slot opening is located on two opposing faces and also centered of the length of the holding means on a second face opposite said first face to allow said stick-urging arm to move in an arcuate path that intersects the second face.

3. A device as in claim 1 wherein said first end has at least two slotted openings positioned near the vehicle attaching end elongated at right angled to the length of the bracket and typically of a width to accept a bolt for effecting the attaching operation.

4. A device as in claim 1 wherein said narrow elongated slot has at least one recessed portion at the side of the slot and at a position at one end of the slot to receive and selectively hold in the cocked position, and in a position that allows a clear path fôr receiving the stick lubricant.

* * * * *